US005274662A

United States Patent [19]

Krepel

[11] Patent Number: 5,274,662

[45] Date of Patent: Dec. 28, 1993

[54] REMELTING ARC FURNACE WITH MOVABLE ELECTRODE

[75] Inventor: Rolf Krepel, Erlensee, Fed. Rep. of Germany

[73] Assignee: Leybold Durferrit, Cologna, Fed. Rep. of Germany

[21] Appl. No.: 900,918

[22] Filed: Jun. 18, 1992

[30] Foreign Application Priority Data

Feb. 18, 1992 [DE] Fed. Rep. of Germany ..... 4204757

[51] Int. Cl.[5] ..... H05B 7/102

[52] U.S. Cl. ..... 373/69; 373/52; 373/67; 373/94; 373/100

[58] Field of Search ..... 373/67, 68, 69, 70, 373/94–96, 100, 102, 49, 50, 52

[56] References Cited

U.S. PATENT DOCUMENTS

| | | | |
|---|---|---|---|
| 3,379,238 | 4/1968 | Sieckman | 373/70 |
| 3,393,264 | 7/1968 | Wynne | 373/70 |
| 3,393,266 | 7/1968 | Wynne | 373/70 |
| 3,459,868 | 8/1969 | Schlienger | 373/69 |
| 3,614,284 | 10/1971 | Scheidig | 373/69 |
| 4,303,797 | 12/1981 | Roberts | 373/70 |
| 4,357,485 | 11/1982 | Lamarque | 373/95 |
| 4,509,807 | 4/1985 | Reimpell et al. | 373/69 |
| 4,637,032 | 1/1987 | Whitman | 373/69 |
| 4,856,576 | 8/1989 | Peterson | 373/72 |
| 4,951,298 | 8/1990 | Müller | 373/67 |

FOREIGN PATENT DOCUMENTS

| | | |
|---|---|---|
| 1157739 | 11/1963 | Fed. Rep. of Germany . |
| 1918713 | 12/1970 | Fed. Rep. of Germany . |
| 3344684 | 6/1985 | Fed. Rep. of Germany . |
| 3917998 | 12/1990 | Fed. Rep. of Germany . |

*Primary Examiner*—Bruce A. Reynolds
*Assistant Examiner*—Tu Hoang
*Attorney, Agent, or Firm*—Felfe & Lynch

[57] ABSTRACT

A remelting furnace has a crucible and a raisable pot placed thereon. An electrode rod leads into the pot through a passage sealed by means of a seal carried by a lower platform. The lower platform is connected to the pot by a hitch having free play, and can be raised together with the electrode rod by a lift means supported on a weighing platform. In this manner weighing of the electrode rod uninfluenced by the friction forces of the seal is possible. Also, it is possible to lift the pot without increasing the structural height of the structure accommodating the remelting furnace.

6 Claims, 2 Drawing Sheets

REMELTING ARC FURNACE WITH MOVABLE ELECTRODE

FIELD OF INVENTION

This invention relates to an improvement in weight measurement of rods used in remelting furnaces.

BACKGROUND OF THE INVENTION

The invention describes a remelting furnace having an assembly comprising a crucible and a pot which is placed thereon. The assembly is sealed off from the exterior to maintain a vacuum therein. The pot can be lifted away from the crucible by a lift means. The pot has a passage through which an electrically meltable electrode rod is guided into the crucible. The rod is sealed by means of a seal and a spring bellows to maintain the vacuum. A lower platform, held by a weighing platform supported by weight measuring cells (strain gauges), holds the stationary portion of the seal and the upper portion of the spring bellows. The lower portion of the bellows rests upon the pot. To control the melting power, the electrode rod is configured so as to be raised and lowered by means of an electrode drive. The electrode rod with its electrode drive is held by the weighing platform.

Remelting furnaces of the kind described above are generally known in the art to produce high-quality metal alloys by the electrical remelting of an electrode rod in a vacuum by the ESR or VAR process. In such remelting furnaces it is necessary to regulate with the greatest possible accuracy the rate at which the electrode rod melts. This rate is controlled by lowering at a controlled rate the electrode rod continuously into the crucible while it is melting, so that its lower end will always reach the same distance into the crucible in response to the melting rate. To move the electrode rod constantly to the desired degree, the electrode rod is supported on a weighing platform on weight measuring cells, so that its weight can be continuously monitored. The lower platform supporting the seal and the spring bellows is also supported by the weighing platform so that the friction between the electrode rod and the seal will not falsify the measurement of the weight.

When the crucible is to be recharged, the pot has to be lifted away from it by the lift means. In previously known remelting furnaces, a frame on which the weighing platform is supported is lifted by a lift means. Thus, when the pot is raised, the entire top of the furnace is raised together with it. Thus, the structural height of the melting furnace is increased by the required elevation of the pot; often this increase in height cannot be accommodated on account of the overhead crane running above the remelting furnace, which would interfere with it. Also, the part of the furnace that has to be raised is very heavy, so that the lift means must be of appropriately stable construction and therefore relatively expensive.

In the prior art, to avoid the increase in height, remelting furnaces have been built in which only the pot with the seal serving as a vacuum stage is raised instead of the entire upper part. In order to compensate the influence of the seal on the measured weight of the electrode rod, an additional weighing system has been associated with the vacuum stage. This kind of construction is very complex and expensive. It has been abandoned because it did not permit sufficiently accurate weighing of the rod.

SUMMARY OF THE INVENTION

The invention is addressed to the problem of building a remelting furnace of the kind described above so that, with the least possible expense, a highly accurate measurement of the weight of the electrode rod will be made possible without increasing the structural height of the remelting furnace to allow for the lifting of the pot away from the crucible.

This problem is solved by the invention in that the lift means is supported on the weighing platform and is designed so as to raise the lower platform, and in that the pot is joined to the lower platform by a hitch allowing free play when the pot is resting on the crucible.

In this embodiment, when the pot is resting on the crucible the seal is not supported on the pot, due to the free play in the hitch. The seal of the pressure stage therefore forms a closed system together with the weighing platform. Therefore, friction between the seal and the electrode rod when the electrode rod is lowered into the box does not lead to inaccuracies of the weight measurement. If the lift means is operated, the free play of the hitch is at first overcome and then the box with the pressure stage bearing the seal is raised up, moving upwardly within an outer frame relative to the electrode rod. Thus the structural height of the remelting furnace is not increased.

In spite of these functional advantages, the remelting furnace according to the invention is very simply constructed. In comparison with the known remelting furnace, some components, for example the tubes for guiding the electrode rod and the outer frame, are eliminated. The components that differ from the known remelting furnace, especially the lift means with its hydraulic unit and cylinder, can also be used for other furnace versions. In accordance with the invention, the lift means can be made smaller and thus less expensive since there is less weight that needs to be lifted. Furthermore, the size of the remelting furnace as a whole is reduced.

The hitch can be configured in various ways. One especially simple embodiment is in the form of upright pins on the pot which pass through the lower platform and have each a head at a slight distance above the top of the lower platform.

A comparatively simple configuration of the hitch connection is formed by claws on the top of the pot and on the lower part of the lower platform, which engage one another with free play. The hitches and claws straddle the center of gravity of the pot.

Oscillation of the electrode rod with the lower platform resulting in the application of lateral forces to the weight cells can be prevented quite simply by providing, in another further improvement of the invention, open-topped guiding cylinders on the top of the pot, into which a guiding roller fastened to the lower platform enters and can roll up and down.

Also at its upper end the electrode rod can be guided in a very simple manner. Lift means having at least two hydraulic jacks fastened on the weighing platform are provided, each of whose piston rods is affixed at its lower end to the lower platform. The electrode rod is fixedly joined to a guiding yoke having guiding passages through which the piston rods are passed.

To prevent weighing errors due to the catenary hanging shape of the high-current cable leading to the electrode rod, which changes with the movement of the electrode rod, a cable hanger is provided on the weighing platform to hold a flexible high-current cable leading to the electrode rod. This high-current cable is then ultimately held at both ends by the weighing platform, so that it does not affect the weighing of the complete assembly. A simple, straight cable can then run from the cable hanger on the weighing platform to the high-current power supply. Since the power supply as well as the frame are stationary, the straight cable to the power supply does not influence the weight measurement.

These together with other objects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

The invention admits of numerous embodiments. To explain it further, one of them, plus a modification of a detail, is represented in the drawing and is described below.

DETAILED DESCRIPTION OF THE PREFERRED EMBODIMENT

Figure 1:
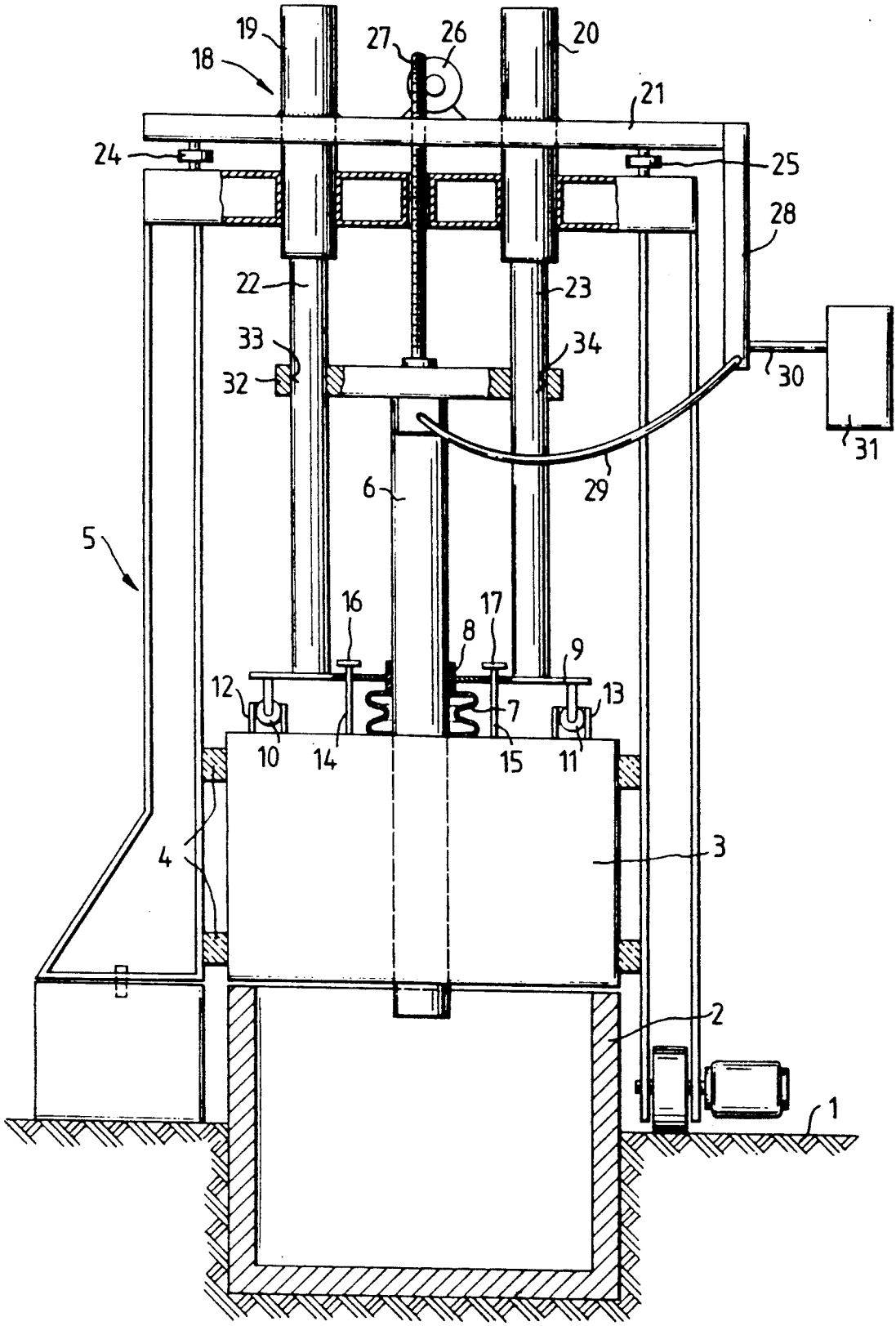
FIG. 1 is a diagrammatic longitudinal section through a remelting furnace according to the invention.

The remelting furnace represented as a whole in FIG. 1 has a crucible 2 let into a base 1, and onto it a pot 3 is lowered sealingly. To simplify FIG. 1, the seal between pot 3 and the crucible 2 is not shown. The pressure in pot 3 can be either negative (i.e. a vacuum) in the order of 0 to 1000 millibars, or positive. If the pot is positively pressurized it typically contains an inert gas. This pot 3 can be moved upwardly in linear guides 4 of a frame 5 configured as a pivoting frame reaching over crucible 2, so that it can be lifted away from the crucible 2. The frame 5 may be pivoted over one or more crucibles to increase production rates. The electrode rod 6 that is to be melted runs downwardly through the pot 3 into the crucible 2. A seal 8 connected to the top of the pot 3 by a spring bellows 7, and held by a lower platform 9 disposed above the top of the pot, serves to seal off the pot 3 in the area where the electrode rod 6 passes through it. To the bottom of this platform 9 are fastened guiding wheels 10 and 11 which enter downwardly into open-topped guiding cylinders 12 and 13. This prevents the lower platform 9 from shifting transversely with respect to the pot 3. Furthermore, pins 14 and 15 are fastened on the top of the pot 3 and pass through the lower platform 9, and they have heads 16 and 17, respectively, at a distance from the top side of the platform 9. These pins form a hitch between the lower platform 9 and the which permits lost motion between the lower platform and the pot 3. If the lower platform is raised, as soon as the heads 16 and 17, after a short free movement, come in contact with the top of the lower platform 9 they carry the pot 3 with them. Pins 14 and 15 straddle the center of gravity of pot 3 which may be of any suitable crossection to accommodate the crossection of crucible 2.

A lifting device 18 serves to lift the pot 3 away from the crucible 2. It has two hydraulic jacks 19 and 20 which are fastened on a weighing platform 21 and have each a piston rod 22 and 23, respectively, whose lower end is affixed to the lower platform 9. A retraction of the piston rods 22 and 23 therefore results in a raising of the lower platform and, after overcoming the axial free play between the heads 16 and 17 and the lower platform 9, it leads to a raising of the pot 3.

The weighing platform 21 rests upon weight measuring cells (strain gauges) 24 and 25 on the frame 5. On platform 21 there is furthermore disposed a servo 26 which drives a threaded spindle 27 which is connected to the electrode rod 6. Furthermore, the weighing platform 21 has on one side a cable hanger 28 on which one end of a high-current cable 29 leading with slack to the electrode rod 6 is fastened. From this cable hanger 28 a direct high-current conductor 30 can lead to a high-current source 31. High current source can be mounted on the roof, the floor or some other convenient place where the conductor 30 will exercise a constant effect on the weight measurement part of the apparatus.

At the upper end of the electrode rod 6, the rod is affixed to a guiding yoke 32 which has near its two outer ends the guiding passages 33 and 34 through Which the piston rods 22 and 23 are respectively passed. When the electrode rod 6 moves downwardly, the guiding yoke 32 slides with these guiding passages 33 and 34 over the piston rods 22 and 23 thereby guiding the upper end of the electrode rod 6.

Figure 2:
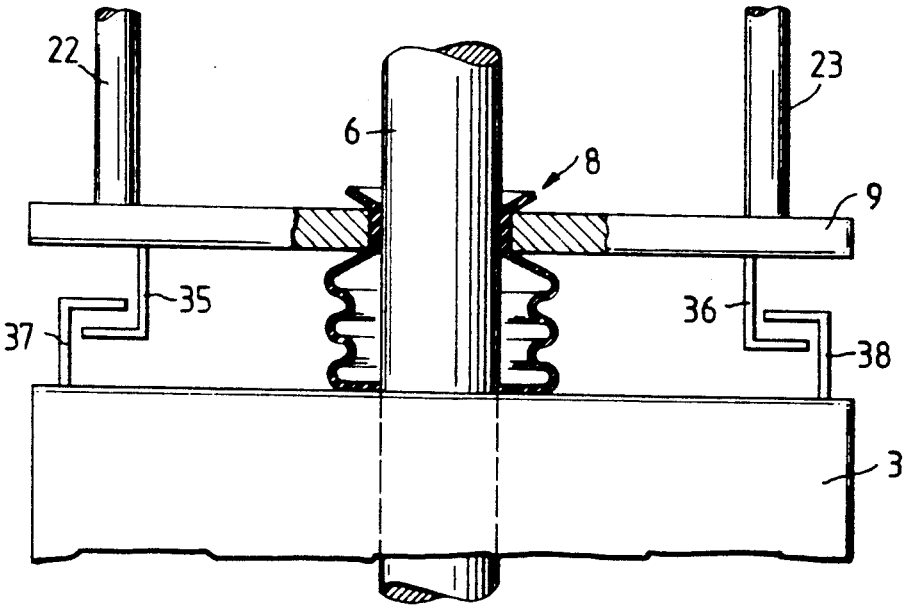
FIG. 2 is a diagrammatic longitudinal section through a portion of the remelting furnace above its pot, which is a modification of FIG. 1.

FIG. 2 shows the upper end of the pot 3 and the lower platform 9 held, together with the seal 8, on the piston rods 22 and 23. In this embodiment, the coupling is in the form of hooks 35, 36, 37 and 38 provided on the lower platform 9 and the upper end of the pot 3, and engaging one another with free play. When the lower platform 9 is raised, first this free play is overcome and only then is the pot raised with it.

Although the present invention has been shown and described with respect to preferred embodiments, various changes and other modifications which are obvious to persons skilled in the art to which the invention pertains are deemed to lie within the spirit and scope of the invention.

It is claimed:

1. Furnace for melting an electrode, comprising:

a crucible, a pot which fits on top of said crucible and receives said electrode therethrough for melting in said crucible, a lower platform above said pot and having a passage for receiving said electrode therethrough, and a seal for sealing said electrode in said passage, a bellows between said seal and said pot, said bellows receiving said electrode therethrough, a weighing platform mounted on weighing cells and carrying said lower platform below said weighing platform, electrode drive means on said weighing platform for raising and lowering said electrode relative to said weighing platform, lifting means for raising and lowering said lower platform relative to said weighing platform, and hitch means connecting said lower platform to said pot with lost motion so that said lower platform does not support said pot when said lower platform is lowered and said pot is on top of said crucible, and so that said pot is raised from said crucible by said lower platform when said lower platform is raised.

2. Furnace as in claim 1 wherein said hitch means comprises a plurality of hitch pins fixed to said pot and a plurality of openings in said lower platform, each hitch pin passing through a respective opening and having a head above said lower platform.

3. Furnace as claim 1 wherein said hitch means comprises a plurality of claws fixed to said pot and a plurality of claws fixed to the said lower platform, each claw on said pot engaging a respective claw on said lower platform when the lower platform is raised.

4. Furnace as in claim 1 further comprises tubular guide cylinders on top of said pot and guide wheels fixed to said platform, said guide cylinders each receiving a respective guide wheel when said platform is lowered.

5. Furnace as in claim 1 wherein said lifting means comprises a pair of hydraulic jacks on said weighing platform and a pair of piston rods fixed to said lower platform and received in said jacks for lifting, said furnace further comprising a guide yoke with a pair of bores slideably receiving said pistons therethrough, said electrode being fixed to said guide yoke.

6. Furnace as in claim 1 further comprising an electrode rod connecting said lifting means to said electrode, and a cable hanger fixed to said weighing platform and a flexible high current cable leading from the cable hanger to the electrode rod.

* * * * *